US006513269B2

(12) United States Patent
Kobayashi et al.

(10) Patent No.: US 6,513,269 B2
(45) Date of Patent: Feb. 4, 2003

(54) STEAM SPRAYER

(75) Inventors: Shinichiro Kobayashi, Osaka (JP); Toshihide Nakamura, Hyogo (JP); Mamoru Ikeshima, Hyogo (JP); Masao Shimizu, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 41 days.

(21) Appl. No.: 09/912,320

(22) Filed: Jul. 26, 2001

(65) Prior Publication Data

US 2002/0020085 A1 Feb. 21, 2002

(30) Foreign Application Priority Data

| | | |
|---|---|---|
| Jul. 28, 2000 | (JP) | 2000-228612 |
| Feb. 27, 2001 | (JP) | 2001-051806 |
| Mar. 7, 2001 | (JP) | 2001-063069 |
| Mar. 28, 2001 | (JP) | 2001-092500 |

(51) Int. Cl.[7] ..... D06F 75/20; D06F 75/38
(52) U.S. Cl. ..... 38/93
(58) Field of Search ..... 38/93, 94, 97, 38/98, 88, 80, 81, 77.4, 90; 219/245, 254, 227, 243

(56) References Cited

U.S. PATENT DOCUMENTS

| | | | | |
|---|---|---|---|---|
| 5,950 A | * | 12/1848 | Cook | 38/93 |
| 1,732,890 A | * | 10/1929 | High | |
| 2,307,370 A | * | 1/1943 | Hale | |
| 2,637,125 A | * | 5/1953 | Roberts | 38/97 |
| 2,659,167 A | * | 11/1953 | Weldon | 38/97 |
| 3,634,957 A | * | 1/1972 | Zeidler | 38/66 |
| 3,675,449 A | * | 7/1972 | Bluestein | 15/176.3 |
| 3,805,425 A | * | 4/1974 | Spoida et al. | 38/69 |
| 4,660,307 A | * | 4/1987 | Fay | 38/94 |
| 5,121,464 A | | 6/1992 | Hanada et al. | |
| 5,664,349 A | * | 9/1997 | White et al. | 38/97 |
| 5,755,049 A | * | 5/1998 | Cohen et al. | 38/66 |
| 5,832,639 A | * | 11/1998 | Muncan | 38/77.6 |

FOREIGN PATENT DOCUMENTS

| | | |
|---|---|---|
| JP | S47-39997 | 12/1972 |
| JP | S52-2030 | 1/1977 |

* cited by examiner

*Primary Examiner*—Ismael Izaguirre
(74) *Attorney, Agent, or Firm*—Wenderoth, Lind & Ponack, L.L.P.

(57) ABSTRACT

A steam sprayer is used in ironing textile products, including clothes. The steam sprayer is user-friendly and offers highly effective ironing. A vaporizing chamber generates steam by vaporizing water stored in a tank. A water-supplying unit supplies the vaporizing chamber with the water. A steam-ejecting section spouts the steam outside. The steams-ejecting section includes a ironing surface with high frictional resistance characteristics. When touching the ironing surface to clothes or other fabrics for ironing, a pulling force is caused by the frictional resistance, which is a preferable wrinkles-off effect. Thus, the steam sprayer offers a synergistic effect brought by spouting the steam and applying the pulling force to clothes, thereby neatly fixing the form of clothes.

33 Claims, 7 Drawing Sheets

STEAM SPRAYER

FIELD OF THE INVENTION

The present invention relates to a steam sprayer used for ironing textile products, including clothes.

BACKGROUND OF THE INVENTION

Prior-art steam sprayers, which iron out the wrinkles in clothes and other fabrics by providing steam, are disclosed in U.S. Pat. No. 5,121,464 and Japanese Patent Examined Publication No. 52-2030. Such steam sprayers include i) a vaporizing chamber heated by a heater, ii) a tank storing water for the vaporizing chamber, and iii) a pump unit sending the water in the tank to the vaporizing chamber.

Steam is generated in the vaporizing chamber and spouted out through steam ejection holes disposed at a steam-ejecting section to clothes and other fabrics for ironing them. The steam-ejecting section is made of a hard material, such as a high-temperature-resistant plastic. The steam-ejecting section contains a brush disposed so as to encircle the steam ejection holes. With the brush, clothes are brushed over and any waste yarn and other adherents are brushed off while the clothes are ironed by steam.

Such a structured steam sprayer spouts out steam to clothes without pressing them. The sprayed steam permeates into fabric fibers, by which the wrinkles in an item are ironed out. Furthermore, the brushing can provide the item with a nice finishing touch during ironing.

Only the spraying steam, however, is not enough for neatly fixing the form of the item. According to the prior-art structure in which the brush is placed around the steam-ejecting section, the brush offers a weak pulling force to an ironed item in the brushing direction. Therefore, with one hand, the user has to hold the sprayer to operate the pump unit for spewing steam, and with the other hand, the, user has to neatly fix the form of the item. This has been an inconvenience for ironing.

In addition, a problem may arise when an item is ironed with the steam ejecting section pressed against the item. That is, the material of the item can be damaged if the steam has a higher temperature than an acceptable level of the material.

As another type of ironing device, Japanese Utility Model Examined Publication No. 47-39997 discloses an iron having a bag filled with heated air, which is pressed against an item to iron out the wrinkles.

The air bag flexibly changes its shape fitting with the form of clothes, allowing the iron to work without spoiling the lines and drapes of clothes for dressing. However, the iron neither comes equipped with a certain "wrinkle off" function, for example, by steam, nor with any particular function that can iron out the wrinkles of the item while neatly fixing its form. Furthermore, from the structural necessity that the air bag is supplied with air by a compressor, the user has to use the iron with the compressor tethered thereto. This has made the iron to be user-unfriendly.

SUMMARY OF THE INVENTION

The present invention addresses the problems above. It is therefore the object of the present invention to provide a user-friendly iron with an increased iron-out function. According to the invention, steam is generated in a vaporizing chamber and then spouted out through a steam-ejecting section. The steam-ejecting section has an ironing surface with high frictional resistance characteristics at a position touching clothes to be ironed.

With the structure, the user can iron out the wrinkles of the item by spouting steam, and at the same time, can fix the form of the item by applying an adequate pulling force. Thus, a steam sprayer with easy-handling and an increased wrinkle-off function can be obtained.

DESCRIPTION OF THE PREFERRED EMBODIMENTS

Figure 1:
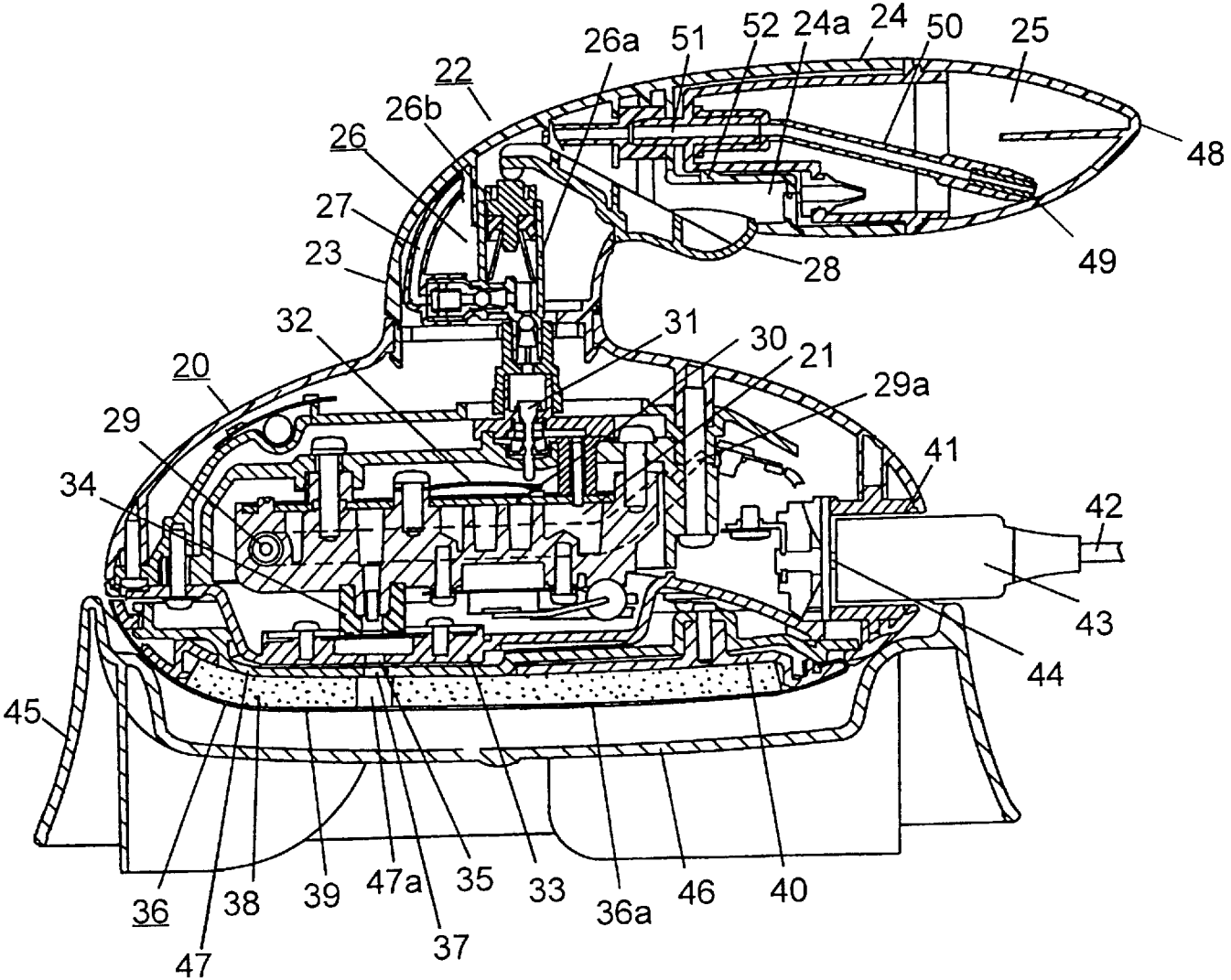
FIG. 1 is a sectional view indicating an essential part of a steam sprayer in accordance with a first preferred embodiment of the present invention.
Figure 2:
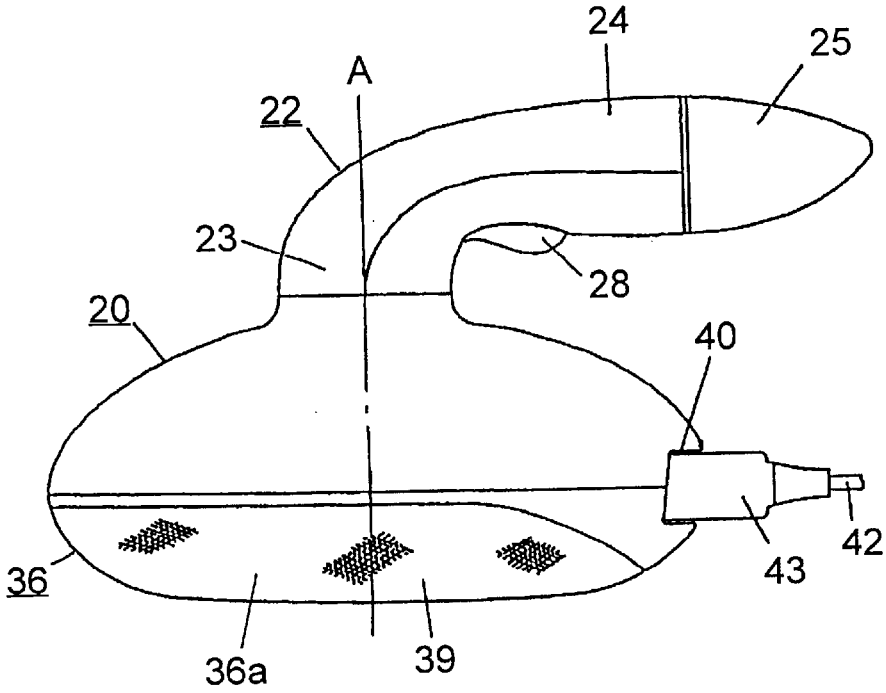
FIG. 2 is a side view of the steam sprayer.

The preferred embodiments of the present invention are described hereinafter with reference to the accompanying drawings.

First Preferred Embodiment

As shown in FIGS. 1 through 5, a steam sprayer 20 includes a vaporizing chamber 21 therein, and a handle 22 at its top.

The handle 22 is in the approximate shape of an "L" formed by a vertical section 23 and a horizontal section 24. The vertical section 23 of the handle 22 is disposed on the top surface of the sprayer 20, at a position "A" determined as an approximate center in its lengthwise direction.

Arranged in the horizontal section 24 so as to be removable, a tank 25 stores water to be sent to a vaporizing chamber 21.

A water-supplying unit 26 is formed from pump units that supply water stored in the tank 25 via a water channel 27 to the vaporizing chamber 21. In the vertical section 23 of the handle 22, a cylinder 26*a* and a piston 26*b* for the pump unit are arranged. An operating unit 28 is arranged at the lower part of the horizontal section 24 of the handle 22. The unit 28 drives the water-supplying unit 26 to supply water to the vaporizing chamber 21 by pressing the piston 26*b*.

Covered with a lid 30, the vaporizing chamber 21 is heated by a heater 29 embedded therein.

A thermal-responding valve unit 31 is placed between the vaporizing chamber 21 and the water-supplying unit 26. The valve unit 31 controls the water supply to the chamber 21 according to the bend of bimetal 32 fixed to the chamber 21.

Figure 3:
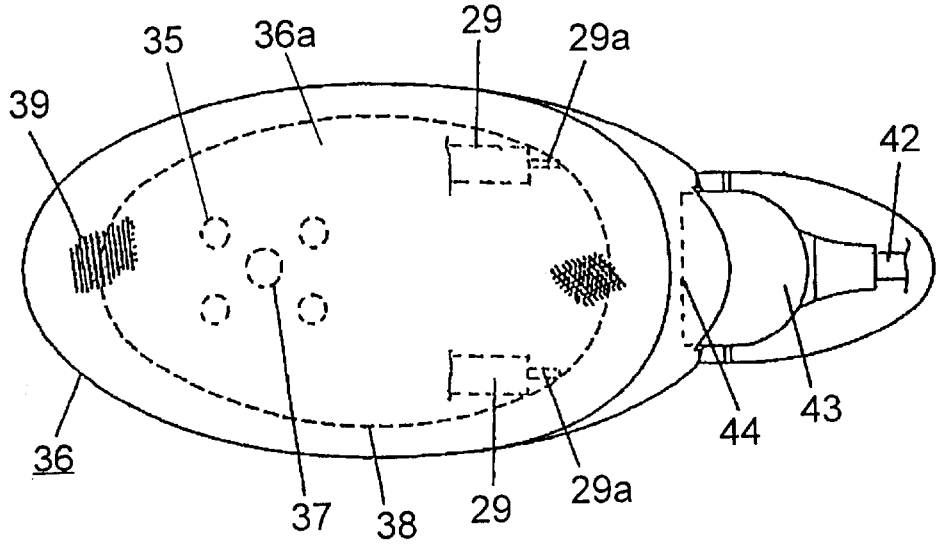
FIG. 3 is a bottom view of the steam sprayer.

As shown in FIGS. 1 and 3, the heater 29 embedded in the chamber 21 is approximately U-shaped. Connectors 29*a* of the heater 29, at the both ends of the U-shape, are slanted upward.

A vaporizing-chamber cover 33 covers the bottom of the vaporizing chamber 21 and is sealed with a packing 34 to the chamber 21. The cover 33 includes steam-ejecting holes 35 through which steam generated in the chamber 21 is spouted.

A steam-ejecting section 36 spouts out steam from the chamber 21. The steam-ejecting section 36 contains a ironing surface 36*a,* which shows high frictional resistance characteristics when it is moved on an item to be ironed.

The ironing surface 36*a* includes a cushion 38, a cloth cover 39, and a plastic-made holder 40. The cushion 38 is made of a steam-permeable foam body and has a opening 37 for allowing steam to pass through. The cover 39 covers the outside of the cushion 38.

The plastic-made holder 40 accommodates the cushion 38 therein, fixing the edge of the cover 39 as well.

The ironing surface 36*a* occupies almost the entire area of the steam-ejecting section 36 so as to cover the holes 35 disposed in the cover 33.

Generated in the vaporizing chamber 21, the steam passes through the holes 35 of the cover 33 then through the opening 37 of the cushion 38, and through the cloth cover 39 to go outside.

The cover 39 is formed from knitted fibers, more specifically, the cover 39 may be a moss-stitched fabric.

In addition, the material of the cover 39 may be cotton, nylon, polyester, or a mixed material, including at least one of them.

The cover 39 of the ironing surface 36*a* is, as described above, made of a soft material including fabrics. The soft materials may be a heatproof cloth.

The top surface of the tail of the sprayer 20 has a downward slant in the direction that the horizontal section 24 of the handle 22 extends, increasing the clearance between the top surface and horizontal the section 24. The clearance is big enough for the user to operate the operating unit 28 by his/her finger, with the handle 22 grasped by one hand.

A socket 41 removably accepts a plug 43 disposed on a power cord 42. The plug 43 may be a magnet-type plug for easy mating and unmating. A fitting section 44 of the plug 43 is positioned between both the connectors 29*a* of the U-shaped heater 29. The power cord 42 is placed at the back of the downwardly slanted top surface of the sprayer 20.

A stand 45 accepts the sprayer 20 thereon. The stand 45 has at its top surface a basin-shaped pit 46 for accommodating the steam-ejecting section 36. When mounted on the pit 46, the sprayer 20 does not reach the bottom of the basin, but rests on the brim; so that a clearance is made between the pit 46 and the ironing surface 36*a* of the steam-ejecting section 36.

The steam-ejecting section 36 is removably attached to the sprayer 20.

A heat shield 47 is disposed at steam-ejecting section on the side of the sprayer 20; Formed so as to cover the vaporizing-chamber cover 33 from the outside, the heat shield 47 includes a through-hole 47*a* for passing through steam at the position opposite to the opening 37. Furthermore, when the steam-ejecting section 36 is attached to the sprayer 20, the heat shield 47 protects the steam-ejecting section 36 from overheating by heat from the vaporizing chamber 21 that is highly heated by the heater 29.

The cylindrical tank 25 is removably arranged in a hollow 24*a*. Having one open end, the hollow 24*a* is disposed in the horizontal section 24 of the handle 22. In addition, the tank 25, which includes a bottom 48, partially protrudes outward from the hollow 24*a* in the horizontal section 24 of the handle 22, thereby forming an inclined outer surface that makes the bottom 48 taper off. A water inlet 49 of the water-supply unit 26 is arranged in the tank 25. The water inlet 49 communicates with the water channel 27 via a flexible tube 50.

Placed at the tank 25 on the side of the horizontal section 24, a joint 51 is removably sealed with the water channel 27.

A lock 52 keeps the tank 25 attached to the handle 22. The lock 52 is formed from the inner surface of the hollow 24*a* in the horizontal section 24 of the handle 22, and bumps and dips disposed opposite to the outer surface of the tank 25. The lock 52 is arranged at the position away from the joint 51, which has a seal bonding with the water channel 27 connecting the tank 25 to the vaporizing chamber 21, and at the position on the lower side of the horizontal section 24 of the handle 22.

Now will be described how such a structured sprayer works.

Prior to ironing, the water tank 25 is attached to the horizontal section 24 of the handle 22. When the heater 29 is energized via the power cord 42, the vaporizing chamber 21 is heated to a predetermined temperature. When the temperature reaches the predetermined level, a bend of the bimetal 32 allows the thermal-responding valve unit 31 to open. Furthermore, when the user manually operates the operating unit 28 to work the water-supply unit 26, water in the tank 25 is sucked from the water inlet 49 into the water channel 27, and the water is sent to the vaporizing chamber 21 through the water-supply unit 26.

Steam generated in the chamber 21 goes through the hole 35 of vaporizing-chamber cover 33 then the opening 37 of the cushion 38, and further passes through the cover 39 of the steam-ejecting section 36. In this way, steam evenly spouted from a wide area of the ironing surface 36*a* can apply a finishing the touch to clothes.

Suppose that the user wants to iron out a suit, with the suit hung on a dress hanger. When the user lightly presses the ironing surface 36*a* of the steam-ejecting section 36 onto the item, the ironing surface 36*a* having the cushion 38 flexibly changing its shape along the lines of the item, with a wide area of the ironing surface 36*a* touched thereto. Therefore, an effective ironing-out will be expected over the wide area of the ironing surface 36*a*.

When the user moves the ironing surface 36*a* in a direction, with the ironing surface 36*a* of the steam-ejecting section 36 touching to the item, a pulling force can be easily generated by sliding the ironing surface 36*a* over the item, because the cloth cover 39 attached to the surface of the face 36*a* has high frictional resistance characteristics. This is also true in ironing an item hung on a dress hanger, in order to get well-pressed clothes, all the user has to do is move the ironing surface 36*a* over the item, with the ironing surface 36*a* lightly pressed onto the item. This relieves the user from "both-hands operation", holding the handle 22 with one hand, and ironing out the item while, keeping its lines neat with the other hand. That is, applying steam to the item and neatly fixing its form in a single-hand operation.

As mentioned earlier, the steam-ejecting section 36 is removably attached to the sprayer 20. The user can detach the steam-ejecting section 36 easily from the sprayer 20 to clean it up, for example, to remove scale formed around the steam-ejecting paths.

Figure 4:
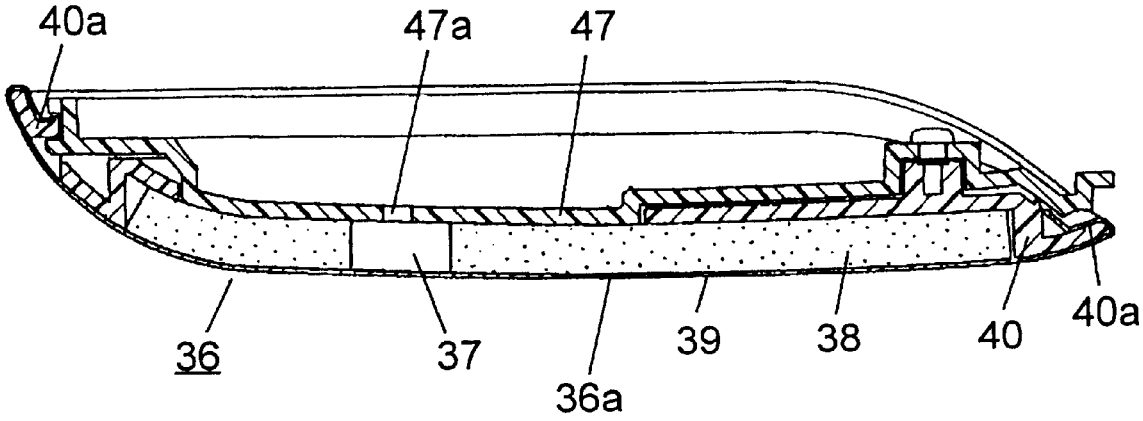
FIG. 4 is a sectional view of a steam-ejecting section removed from the steam sprayer.
Figure 5:
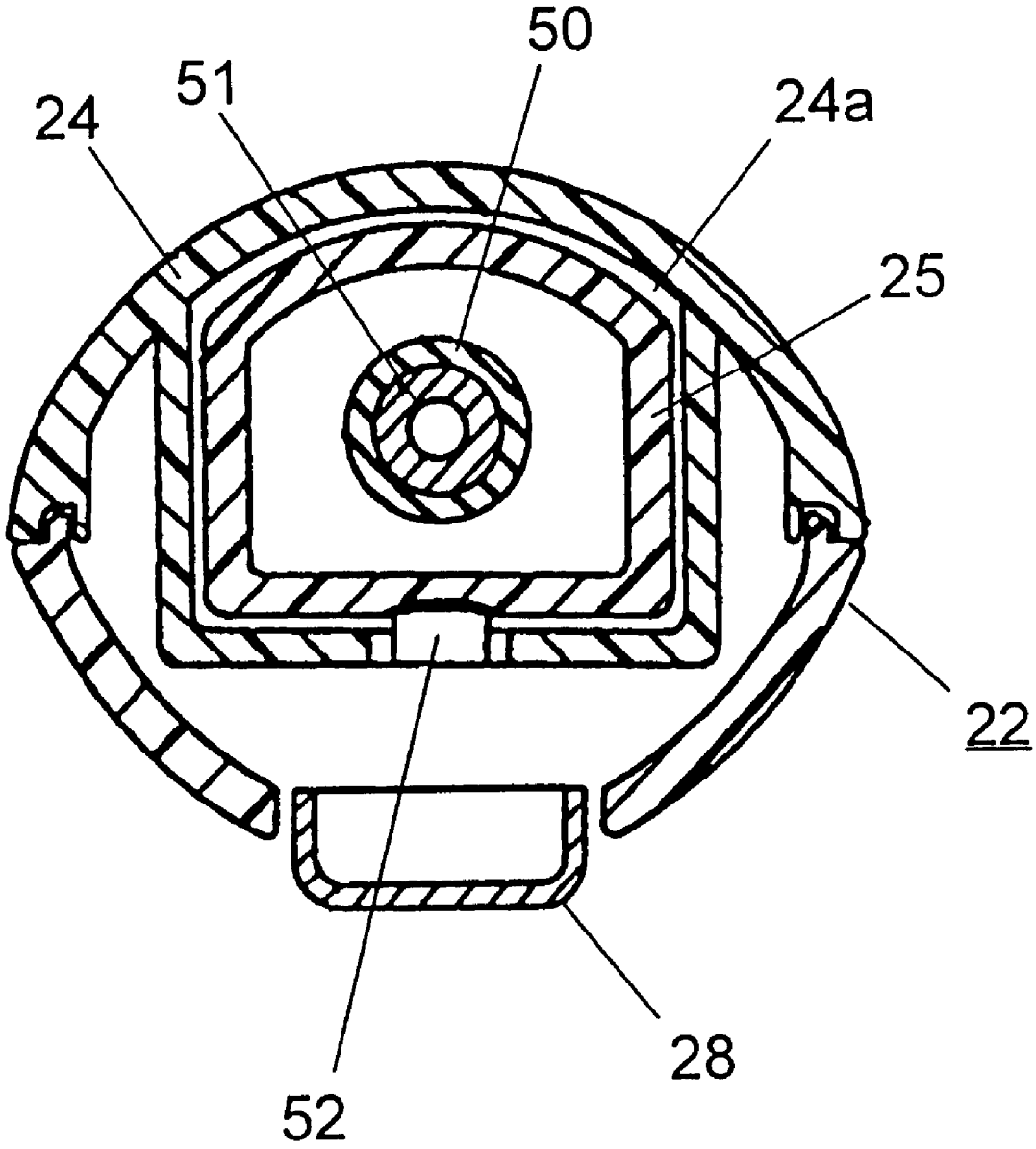
FIG. 5 is a sectional view indicating the essential part of the steam sprayer.

As shown in FIG. 4, the edge of the cover 39 is thermally bonded onto the upper side of the outer edge 40*a* of the holder 40. Therefore, the bonded seam of the cover 39 never touches the clothes. That is, the cover 39 is securely attached to the holder 40, keeping its position right under the applied pulling force generated from friction between the cover and the item to be ironed. As a result, the sprayer can provide the item with an adequate pulling force, with the cushion 38 thoroughly covered by the cover 39.

Although the embodiment shows the thermal bonding as an example to obtain a secure bonding between the cover 39 and the holder 40, the cover 39 and the holder 40 may be formed in one piece.

The cover 39 placed over the ironing surface 36*a* may be made of fabrics with moss-stitch or other stitches having similar pattern. Such a knitted cover allows the ironing surface 36*a* to be held in place when the ironing surface 36*a* with the cover is moved across the surface of clothes. As an additional plus, knitting the cover with a moderately loose stitch can decrease the resistance to passing steam through the cover, ensuring the steam to smoothly spouts out.

In addition, the material of the cover 39 may be cotton, nylon, polyester, or a mixed material including at least one of them. Such materials make the cover 39 tough and durable against ripping or other damage from steam or friction between the cover and the item in touching the ironing surface 36*a* to clothes for a long period.

The vertical section 23 of the handle 22 is situated at a general middle lengthwise of the sprayer 20 having the steam-ejecting section 36. This positioning can apply a well-balanced force to the steam-ejecting section 36 of the sprayer 20. In other words, the structure reduces the strain put on the user's hand grasping the handle 22 in pressing the steam-ejecting section 36 onto an item, or moving the sprayer 20 in a desired direction, with the ejecting section 36 touching the item.

Second Preferred Embodiment

Figure 6:
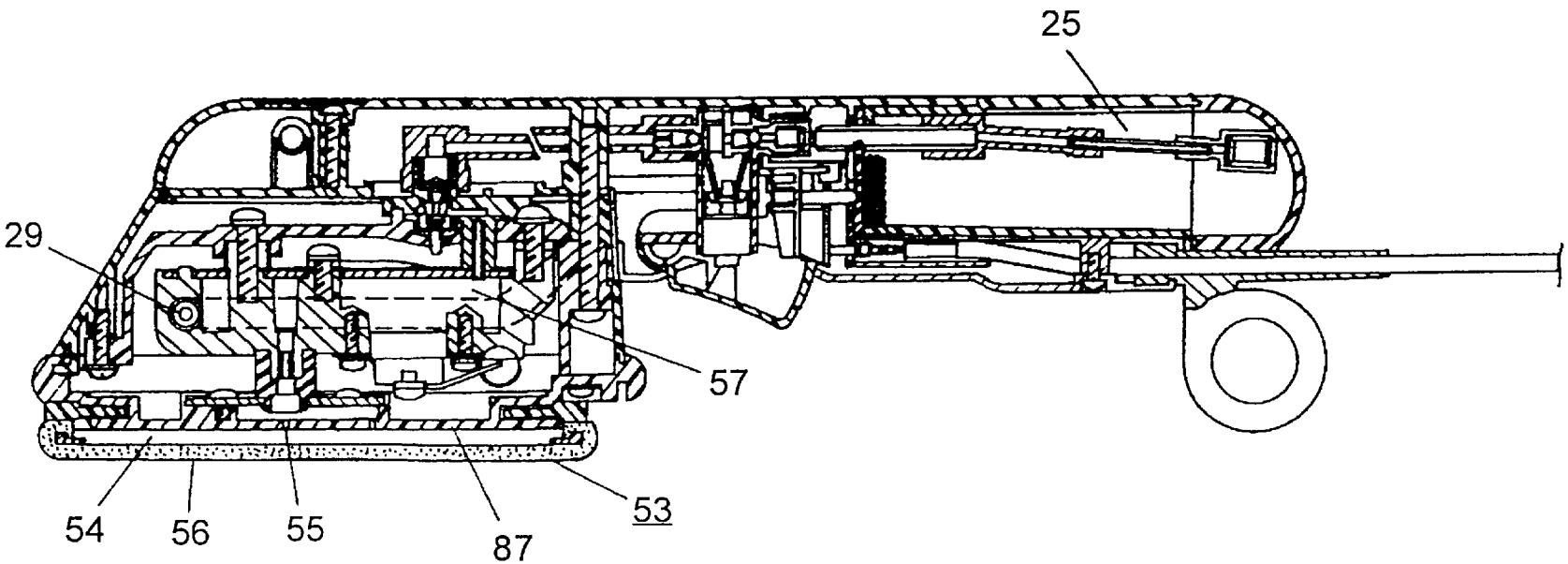
FIG. 6 is a sectional view indicating an essential part of the steam sprayer in accordance with a second preferred embodiment of the present invention.

According to the embodiment, as shown in FIG. 6, a steam-ejecting section 53 includes a heat-resistance section 54. The heat-resistance section 54 is a layer of air formed between a steam-ejecting outlet 55 and an ironing surface 56. When spouted out from the ironing surface 56 via the outlet 55 and the heat-resistance section 54, steam practically has a low temperature. That is, to lower the temperature to an optimum level, the heat-resistance section 54 is designed to have higher heat-resistance than the aluminum alloy forming a vaporizing chamber 57.

Now will be described how such a structured sprayer works.

Generated in the vaporizing chamber 57, steam is led to the steam-ejecting section 53. The steam further goes through the steam-ejecting outlet 55 disposed on a base 87, and then through the heat-resistance section 54. The steam passes through the heat-resistance section 54 before spouting off evenly over the entire area of the ironing surface 56. In the section 54, the temperature of the steam is lowered to a level suitable for ironing clothes, allowing the item to be ironed out with no damage to the material of the item. That is, well-controlled steam protects the clothes from damage to the fabrics, which has been likely to occur in the prior-art, due to the proximity of the steam-ejecting section, via the ironing surface, to the item to be ironed.

The ironing surface 56 is arranged over the steam-ejecting section 53 that touches safely to clothes and other fabrics. The ironing surface 56 is always exposed to outside air. Furthermore, the heat-resistance section 54, which is formed between the ironing surface 56 and the base 87 communicating with vaporizing chamber 57, controls the temperature of the steam. Such a structure protects the ironing surface 56 from having excessively increased temperature, ensuring that the heat-resistance section 54 maintains high heat-resistance characteristics.

Third Preferred Embodiment

Figure 7:
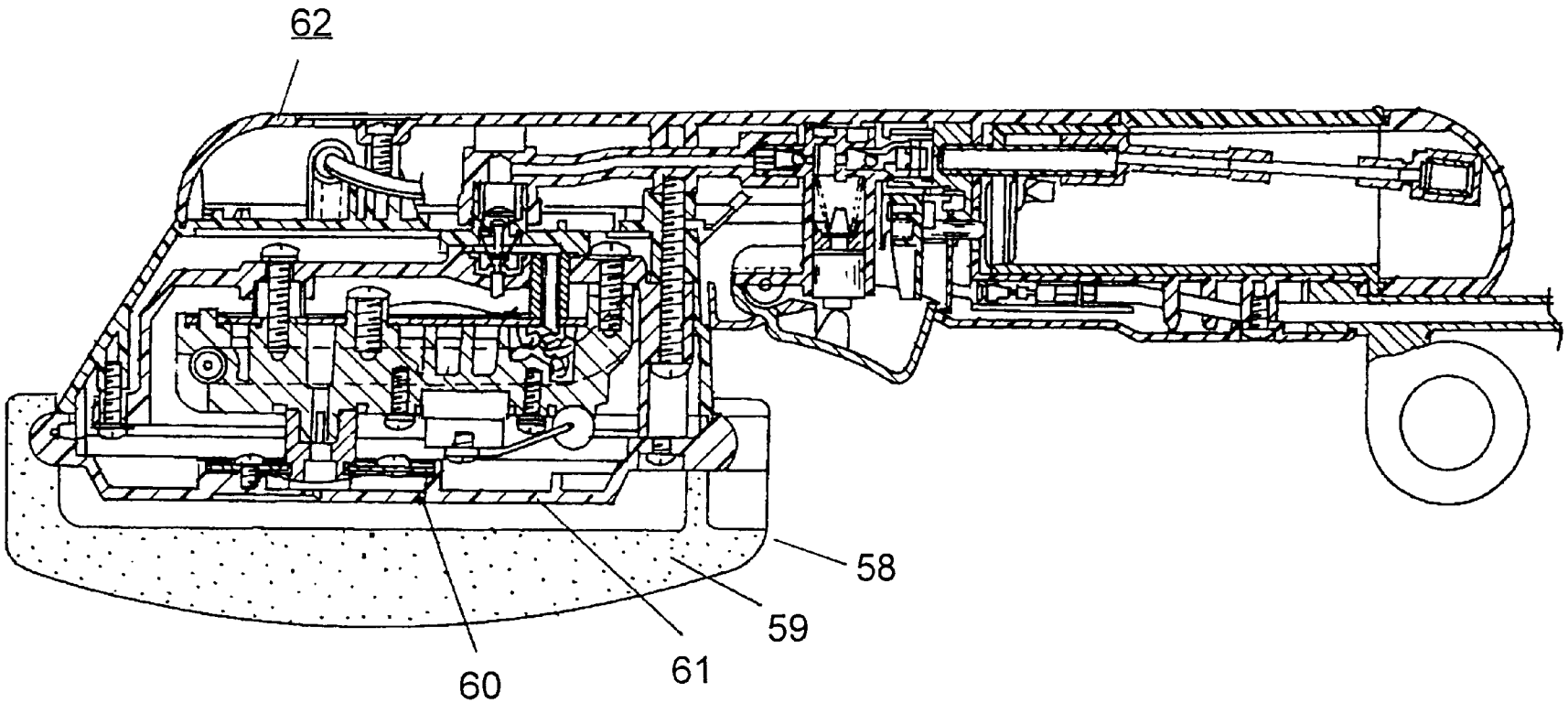
FIG. 7 is a sectional view indicating an essential part of the steam sprayer in accordance with a third preferred embodiment of the present invention.
Figure 8:
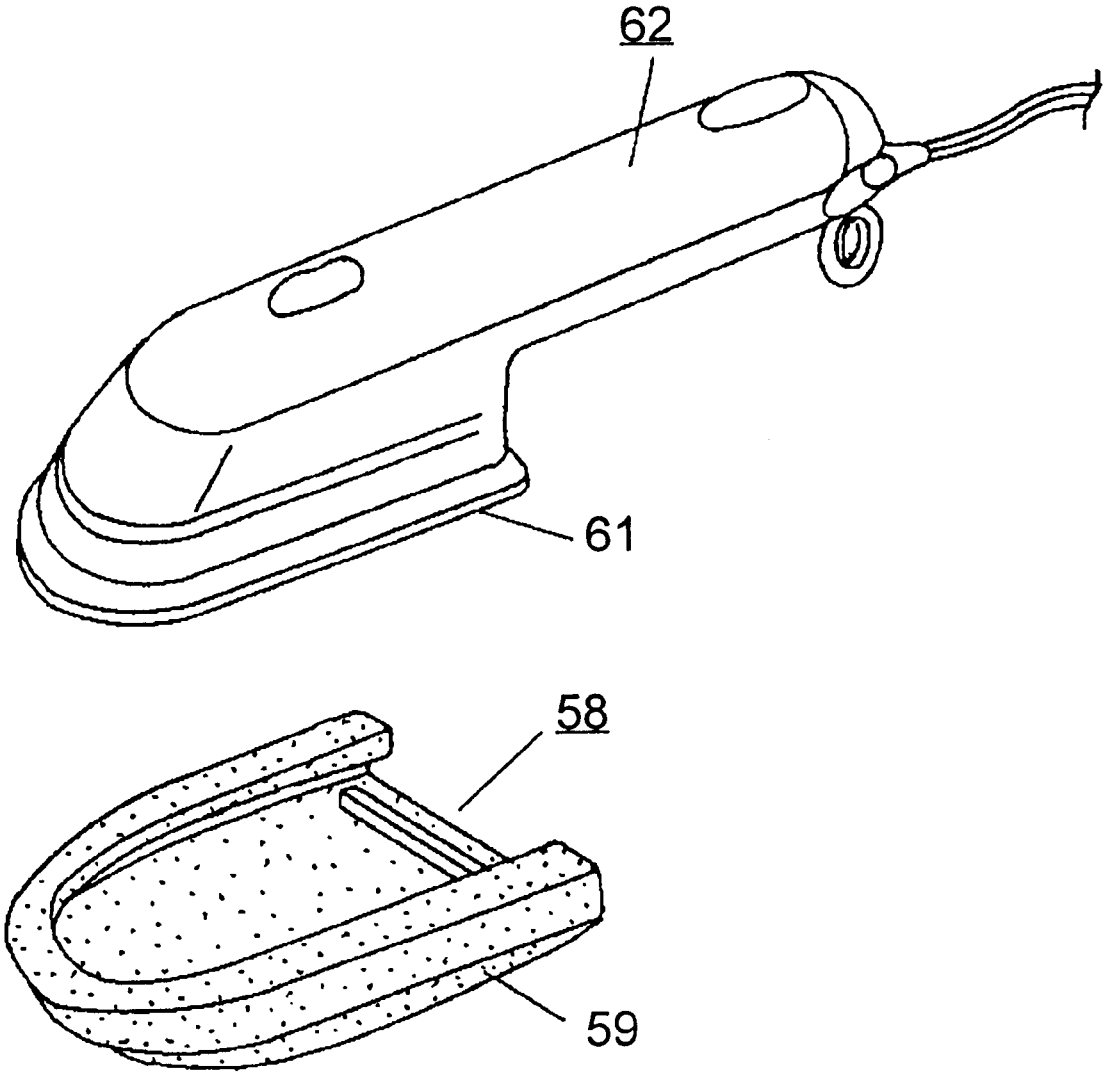
FIG. 8 is an external perspective view of the steam sprayer with the steam-ejecting section detached from the sprayer.

According to a steam-ejecting section 58 of the embodiment shown in FIGS. 7 and 8, an ironing surface 59 having a safe touch to clothes or other fabrics is made of a soft material with a porous structure.

A base 61, which is made of a heat-resistant hard material, such as a high-temperature-resistant plastic, has a steam-ejecting hole 60 therein. The steam-ejecting section 58 fixed to the base 61 is easily detached from or attached to a sprayer 62. In the embodiment, the hard base 61 supports the soft face 59.

The ironing surface 59 is made of a steam-permeable foam body having chains of air bubbles therein, more specifically, a heat-resistant silicon foam body.

With the above structure, a higher frictional resistance can be generated when touching the ironing surface 59 to fabrics to be ironed. Therefore, as the ironing surface 59 moves in a direction with the ironing surface touched to an item, the item is pulled in the direction due to the high frictional resistance. A synergistic effect brought about by the steam and the pulling force applied to the item contributes to improved ironing by which wrinkles are easily out.

The ironing surface 59 is formed in a shape so as to plump outward, such as a spherical shape. Such a structured ironing surface is also applicable in the previous two embodiments.

When the ironing surface 59 lightly touches an item, the plumped center of the ironing surface contacts a small area to the item. The more force the user exerts on the ironing surface 59, the larger the area of the ironing surface that is pressed onto the item. Thus, the frictional resistance between the ironing surface and an item can be varied according to the area of the ironing surface touching the item.

According to the first preferred embodiment, as described earlier, the ironing surface touching the clothes has high frictional resistance. Therefore, a synergistic effect, the pulling force applied the to clothes while the steam is spouting, neatly fixes the item, allowing the sprayer to be user-friendly and provide highly effective ironing.

In addition, the ironing surface can serve as a pad-cloth, protecting clothes from excessive heat or steam. This fact offers "pad-cloth-free" ironing to the user even when ironing clothes made of a delicate material that needs a pad-cloth.

In employing the structure in which the ironing surface contains the cushion therein, the cushion can hold the cover with elasticity, thereby applying an adequate pressure to clothes for highly effective ironing.

Employing the cushion having a steam-permeable hole reduces the resistance of passing the steam through the cushion, ensuring smooth spouting of the steam.

In addition, with the cushion made of the steam-permeable foam body, the steam can be spout out from a broad area of the steam-ejecting section touching the clothes via the cushion.

Furthermore, in a case where the ironing surface occupies almost the entire area of the steam-ejecting section, the user can control the pulling force applied to the clothes by touching the whole or part of the ironing surface to the clothes. This will be helpful in neatly fixing the form of the item.

According to the second preferred embodiment, the heat-resistance section controls the temperature of steam spouted from the steam-ejecting outlet so as to be suitable for giving the finishing touch to the item. The simply structured heat-resistance section can offer highly effective ironing with no damage to clothes.

According to the third preferred embodiment, the ironing surface is made of a soft material with a porous structure. Therefore, a higher frictional resistance can be generated when touching the ironing surface to fabrics. That is, a synergistic effect brought by the steam and the pulling force applied to the item contributes to improved ironing by which the wrinkles are easily removed.

It is thus possible to provide the ironing surface with elasticity and heat resistance characteristics by employing a structure through which steam smoothly passes and an elastic pressing force can be applied when the ironing surface touches fabrics.

What is claimed is:

1. A steam sprayer comprising:

a tank operable to store water;

a vaporizing chamber operable to generate steam by vaporizing the water;

a water-supply unit operable to supply the water to said vaporizing chamber; and a steam-ejecting section including a soft ironing surface having a cover formed over said soft ironing surface, said soft ironing surface being operable to contact a textile product with high friction resistance, said steam-ejecting section being operable to spout the steam to the outside, wherein said tank, said vaporizing chamber, said water-supply unit and said steam ejecting section are accommodated in said steam sprayer, and said steam sprayer irons the textile product while moving on the textile product and a shape of said soft ironing surface is adapted to flexibly change along a shape of the textile product while said steam sprayer moves on the textile product.

2. A steam sprayer according to claim 1, wherein said cover is a cloth-cover.

3. A steam sprayer according to claim 2, wherein said cloth-cover is made of knitted textiles.

4. A steam sprayer according to claim 2, wherein said cloth-cover is knitted with moss-stitches.

5. A steam sprayer according to claim 2, wherein said cloth-cover is made of at least one of cotton, nylon, and polyester, or made of a mixed material including at least one of cotton, nylon, and polyester.

6. A steam sprayer according to claim 1, wherein said steam-ejecting section comprises:

a cushion passing through the steam;

a cloth-cover covering an outer surface of said cushion; and a holder fixing said cloth-cover and accommodating said cushion therein.

7. A steam sprayer according to claim 6, wherein said cushion is made of a steam-permeable foam body.

8. A steam sprayer according to claim 6, wherein said cushion has a hole formed therein for passing the steam through.

9. A steam sprayer according to claim 6, wherein said cloth-cover is bonded to said holder by heat.

10. A steam sprayer according to claim 6, further comprising a heat shield arranged between said steam-ejecting section and said vaporizing chamber.

11. A steam sprayer according to claim 1, wherein said steam-ejecting section is removable.

12. A steam sprayer according to claim 1, wherein said steam-ejecting section comprises a steam-ejecting outlet, and a heat-resistance section between said steam-ejecting outlet and said soft ironing surface.

13. A steam sprayer according to claim 12, wherein said heat-resistance section contains a layer of air disposed between said steam-ejecting outlet and said soft ironing surface.

14. A steam sprayer according to claim 1, wherein said soft ironing surface is formed in a substantially whole area of said steam-ejecting section.

15. A steam sprayer according to claim 1, wherein said soft ironing surface is shaped so as to plump outward.

16. A steam sprayer comprising:

a tank operable to store water;

a vaporizing chamber operable to generate steam by vaporizing the water;

a water-supply unit operable to supply the water to said vaporizing chamber;

a steam-ejecting section having a soft ironing surface, said steam-ejecting section being operable to spout the steam to the outside; and a cloth-cover formed over said soft ironing surface, wherein said cloth-cover is made of knitted textiles.

17. A steam sprayer according to claim 16, wherein said cloth-cover is made of at least one of cotton, nylon, and polyester, or made of a mixed material including at least one of cotton, nylon, and polyester.

18. A steam sprayer according to claim 16, wherein said steam-ejecting section comprises a steam-ejecting outlet, and a heat-resistance section between said steam-ejecting outlet and said soft ironing surface.

19. A steam sprayer according to claim 16, wherein said heat-resistance section contains a layer of air disposed between said steam-ejecting outlet and said soft ironing surface.

20. A steam sprayer according to claim 16, wherein said soft ironing surface is formed in a substantially whole area of said steam-ejecting section.

21. A steam sprayer according to claim 16, wherein said soft ironing surface is shaped so as to plump outward.

22. A steam sprayer comprising:

a tank operable to store water;

a vaporizing chamber operable to generate steam by vaporizing the water;

a water-supply unit operable to supply the water to said vaporizing chamber;

a steam-ejecting section having a soft ironing surface, said steam-ejecting section being operable to spout the steam to the outside; and a cloth-cover formed over said soft ironing surface, wherein said cloth-cover is knitted with moss-stitches.

23. A steam sprayer comprising:

a tank operable to store water;

a vaporizing chamber operable to generate steam by vaporizing the water;

a water-supply unit operable to supply the water to said vaporizing chamber; and a steam-ejecting section operable to spout the steam to the outside, said steam-ejecting section including a soft ironing surface, and said steam-ejecting section comprising a cushion passing through the steam, a cloth-cover covering an outer surface of said cushion, and a holder fixing said cloth-cover and accommodating said cushion therein, wherein said cloth-cover is bonded to said holder by heat, and wherein said steam sprayer irons a textile product while moving on the textile product and a shape of said soft ironing surface is adapted to flexibly change along a shape of the textile product while said steam sprayer moves on the textile product.

24. A steam sprayer according to claim 23, wherein said cushion is made of a steam-permeable foam body.

25. A steam sprayer according to claim 23, wherein said cushion has a hole formed therein for passing the steam through.

26. A steam sprayer comprising:

a tank operable to store water;

a vaporizing chamber operable to generate steam by vaporizing the water;

a water-supply unit operable to supply the water to said vaporizing chamber;

a steam-ejecting section operable to spout the steam to the outside, said steam-ejecting section including a soft ironing surface, and said steam-ejecting section comprising a cushion passing through the steam, a cloth-cover covering an outer surface of said cushion, and a holder fixing said cloth-cover and accommodating said cushion therein; and a heat shield arranged between said steam-ejecting section and said vaporizing chamber, wherein said steam sprayer irons a textile product while moving on the textile product and a shape of said soft ironing surface is adapted to flexibly change along a shape of the textile product while said steam sprayer moves on the textile product.

27. A steam sprayer according to claim 26, wherein said cushion is made of a steam-permeable foam body.

28. A steam sprayer according to claim 26, wherein said cushion has a hole formed therein for passing the steam through.

29. A steam sprayer comprising:

a tank operable to store water;

a vaporizing chamber operable to generate steam by vaporizing the water;

a water-supply unit operable to supply the water to said vaporizing chamber; and a steam-ejecting section including an ironing surface made of a soft foam bodied material with a porous structure, said steam-ejecting section being operable to spout the steam to the outside, wherein said tank, said vaporizing chamber, said water-supply unit and said steam ejecting section are accommodated in said steam sprayer, and said steam sprayer irons the textile product while moving on a textile product and a shape of said soft ironing surface is adapted to flexibly change along a shape of the textile product while said steam sprayer moves on the textile product.

30. A steam sprayer according to claim 29, wherein said ironing surface is made of a heat-resistant silicon foam body.

31. A steam sprayer according to claim 29, wherein said ironing surface is made of a fibrous material.

32. A steam sprayer according to claim 29, wherein said steam-ejecting section further comprises a base made of a hard material having a steam-ejecting hole.

33. A steam sprayer according to claim 29, wherein said steam-ejecting section is removable.

* * * * *